United States Patent [19]

Kuchenbecker

[11] Patent Number: 5,035,330

[45] Date of Patent: Jul. 30, 1991

[54] RECLOSABLE CARTON WITH HORIZONTAL SIDE POUR SPOUT

[75] Inventor: Morris W. Kuchenbecker, Neenah, Wis.

[73] Assignee: James River Corporation, Richmond, Va.

[21] Appl. No.: 294,433

[22] Filed: Jan. 6, 1989

[51] Int. Cl.[5] ..... B65D 5/70

[52] U.S. Cl. ..... 206/621.4; 206/626

[58] Field of Search ..... 206/607, 611, 621.3, 206/621.4, 626, 621.6

[56] References Cited

U.S. PATENT DOCUMENTS

| | | | |
|---|---|---|---|
| 1,956,238 | 4/1934 | Jackson | 229/17 |
| 2,360,415 | 10/1944 | Gilbert | 206/626 |
| 3,203,616 | 8/1965 | Bolton et al. | 206/626 |
| 3,226,003 | 12/1965 | Hickin | 229/17 |
| 3,438,565 | 4/1969 | Lugt et al. | 229/17 |
| 3,549,079 | 12/1970 | Northrup | 206/621.6 |
| 3,563,447 | 2/1971 | Katzenmeyer | 229/17 |
| 4,577,762 | 3/1986 | Kuckenbecker | 206/626 |
| 4,809,853 | 3/1989 | Weber | 206/621.4 |

FOREIGN PATENT DOCUMENTS

| | | | |
|---|---|---|---|
| 2912717 | 10/1980 | Fed. Rep. of Germany | 206/626 |
| 1353079 | 5/1974 | United Kingdom | 206/621.3 |

*Primary Examiner*—Gary Elkins

*Attorney, Agent, or Firm*—Sixbey, Friedman, Leedom & Ferguson

[57] ABSTRACT

A disposable paperboard carton formed from an integral paperboard blank, has an improved opening feature, the improved opening feature comprised of a side wall of the carton having an outer layer of paperboard having a pull type closure tab which allows for the opening of the carton and dispensing of a contained product and which allows reclosure of the carton by inserting a portion of the tab in a cutout slot for storing the contents for further use, and an inner layer of paperboard having a T-shaped cutout for the pour spout. The pour spout size to be selected in accordance with the size of the product to be contained in the carton, with the closure tab being of a constant size and configuration. The closure tab being arranged on the outer layer so as to overlay the cutout formed in the inner layer.

38 Claims, 2 Drawing Sheets

RECLOSABLE CARTON WITH HORIZONTAL SIDE POUR SPOUT

BACKGROUND

Disposable paperboard cartons have long been commercially available for storing, transporting and selling both powder and granular type materials. For decades, these cartons contained metal pour spouts which were hinged to allow easy opening of the carton for initial use and easy closing of the carton for storage.

In an effort to reduce the costs of manufacture and the complexity of carton making machinery, fabricators have sought ways to replace the metal pour spout with one made of paperboard.

A number of containers have been designed wherein the pour spout and reclosure tab are constructed of paperboard. One such design is illustrated in U.S. Pat. No. 3,226,003 to Hickin. This patent discloses a carton having a vertically extending spout located in its narrow side wall together with a reclosable tab. Reclosure is effected by pushing the lower end of the tab into a discharge opening formed in an underlying sidewall. This reclosure feature was an improvement over prior containers. However, by cutting the discharge opening from the lateral edge of the carton blank, the integrity of the carton during manufacture may be affected, and the stability to vary the size of the discharge opening for varying product size without necessitating a change in the closure flap is not possible. The closure flap pivots about a horizontal hinge line and lifting of the tab is in an upward vertical direction.

U.S. Pat. No. 3,563,447 issued to Katzenmeyer discloses a carton having a horizontal pull tab with a vertical pour spout. The tear panel pivots about a vertical fold line. However, the discharge opening is provided by limiting the length of the underlying panel making it impossible to vary the size of the spout opening without significantly altering the closure flap as well.

SUMMARY OF THE INVENTION

A carton constructed according to the teachings of this invention is made from conventional paperboard stock which may be coated on one or both sides with low density polyethylene (LDPE). A one piece blank is used in order to minimize cost of manufacture and the reclosure tab is an integral part of the paperboard blank.

The box configuration comprises four side panels, a bottom and a top. An inside panel having an extension panel is also provided. The bottom of the carton consists of two dust flaps and two end panels. The top of the carton also consists of two dust flaps and two end panels. The inside panel has a precut pour spout opening and is bonded to the inside of one of the side panels. The side panel which is attached to the inside panel contains a closure tab which is defined by a combination of reverse cut score lines in a horizontal direction, a cut edge on one vertical side and a hinged score line on the other which is aligned with the fold line between adjacent side panels. These reverse cut score lines allow ply separation to occur along the pour spout edges and defines the pour spout opening in the outer panel. As described above, the closure tab maybe hinged about one of the cartons fold lines and allows for maximum opening of the pour spout area independent of the actual size of the pour spout opening.

A T shaped pour spout opening allows for easy secure reclosure of the closure tab. Additionally, product sifting after reclosure is resisted due to the tight frictional engagement of the edges of the opening tab against the ends of the T shaped cut out.

The configuration of the pour spout allows great flexibility in the type of product packaged and stored in the carton. If the contents are course, the pour spout opening is enlarged to accommodate the large size granules. If the contained product is fine, the pour spout size is reduced so as to limit the rate at which the carton content are dispensed which in each instance, the size and configuration of the closure tab remains constant. This allows the carton to be inexpensively and readily adapted for any size product.

THE DRAWINGS

DETAILED DESCRIPTION

Figure 1:
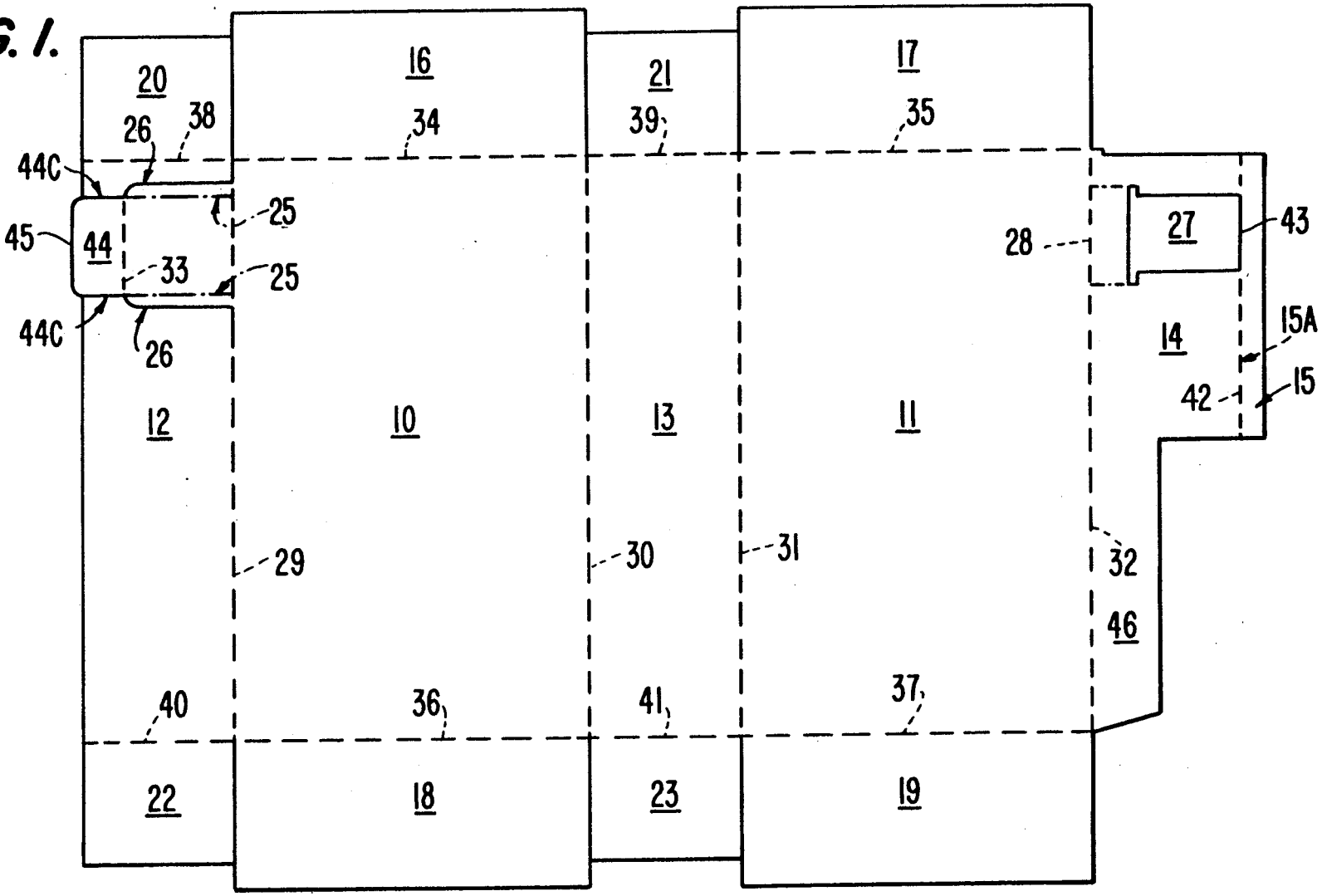
FIG. 1 is an outside plan view of a paperboard carton blank which has been cut and scored in accordance with this invention.
Figure 2:
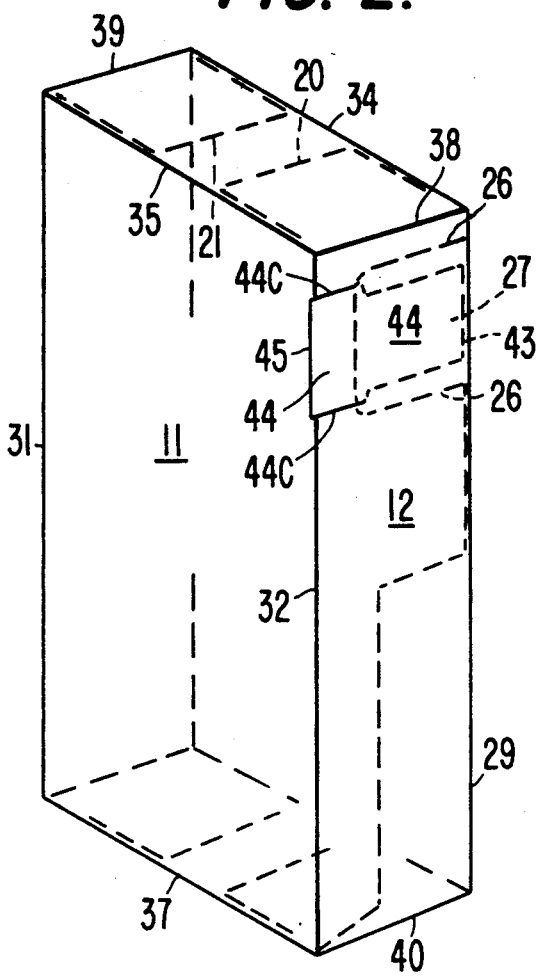
FIG. 2 is a perspective view of a carton which is constructed from the carton blank of FIG. 1 and illustrates the position of the closure tab prior to initial opening and use.

The carton blank illustrated in FIG. 1 is cut from an integral conventional paperboard blank. As would be obvious to one skilled in the art, score lines 29, 30, 31 and 32 became fold lines for the carton and delineate panels 10, 11, 12, 13, and inside panel 14. Panels 10 and 11 become the main panels of the carton. Panels 12 and 13 become the side panels. The top flaps are 16, 17, 20 and 21. When folded inward, these flaps become the top of the box with the outermost flap 16 being glued to inner flap 17. Similarly, flaps 18, 19, 22, and 23 become the bottom of the container with the outermost flap 18 being glued to inner flap 19. Perforation line 15A allows for easy folding of panel extension 15 which extends from the inside panel 14.

Inside panel 14 is attached and adhesively bonded to the inside of panel 12. Side panel 12 has a closure tab 44 which is defined by edge cut 45, cut lines 44C, reverse cut score lines 25, 26 and hinge line 29. Reverse cut score lines 26 are formed on the outer side panel 12 while reverse cut score lines 25 are formed on the inner surface of side panel 12. Inside panel 14 has a cutout 27 which is T shaped and an outside cut score area 28. The closure tab 44 also crease score line 33 for ease of bending when reclosing the tab.

During manufacture of the carton, adhesive is applied to the glue area 46 and the full length of inside panel 14 between the cut out 27 and cut scored area 28. The inside panel 14 is folded on crease score line 32 and the main panel 10 is folded on crease score line 30. This type of gluing is known to the industry as edge gluing.

The area of the closure tab 44 between the crease line 33 and the edge cut 45 is bonded to the cut score area 28 of inside panel 14. When the closure tab 44 is grasped for initial opening, the cut score area 28 will ply separate beginning at a point of weakness at a leading edge cut score of area 28. To open the container, the user grasps the point of initial opening at edge cut 45 and tears back to the hinge line 29 or a crease line which may be formed in the panel 12. The region between reverse cut score lines 25 and 26 will ply separate at the point where they intersect and extend to the hinge line 29. The hinge line 29 then becomes the hinge line for the closure tab 44. To close the opening, formed by the cutout closure 27 tab 44 is folded on score line 33 and an extending end therof is inserted into the T slot of cutout 27.

Figure 3:
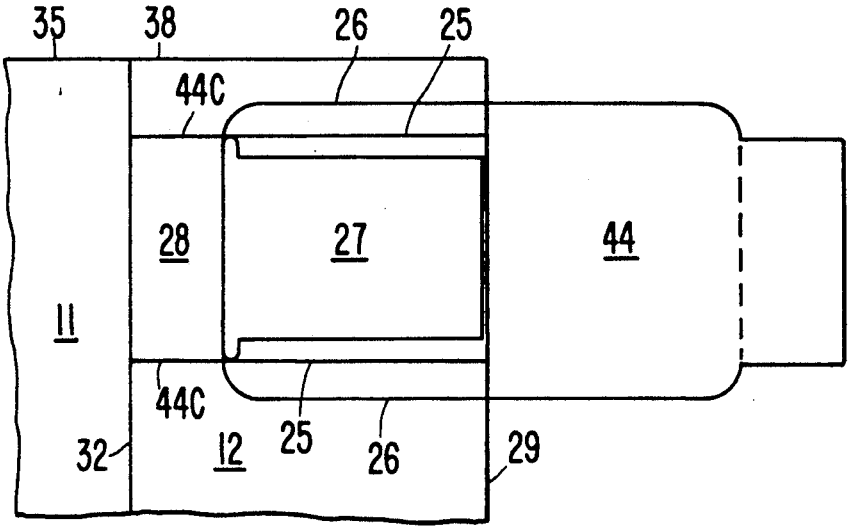
FIG. 3 is a plan view of panel 12 showing the closure tab in its fully extended position.

The closure tab 44 is shown in its open and fully extended or open position in FIG. 3. The area between reverse cut lines 25 and 26 shows ply separation over the full length of the cut score line 26. The ply separation along both edges of the closure tab 44 is symmetrical. Also shown is ply separation in the cut score area 28.

Figure 4:
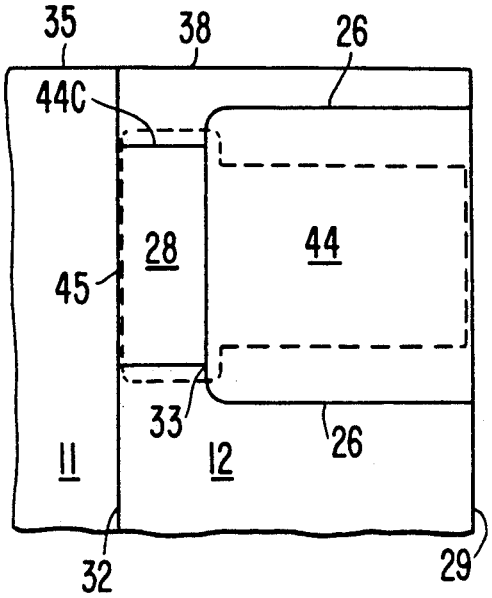
FIG. 4 is a plan view of panel 12 showing the closure tab in its fully reclosed position.

FIG. 4 illustrates a view of the container with the closure tab 44 inserted in the T slot of cutout 27. The closure tab 44 may be hinged along the score line 29. Prior to reclosing the carton, the end of the closure tab is folded inward at crease score line 33. After bending the closure tab end inward, it is inserted into the T slot of cutout 27. The pour spout is securely and tightly reclosed for storage pending further use. The disclosed carton can therefore be sealed tight enough to resist shifting and can be easily reopened for further dispensing.

The size of the cutout 27 can be enlarged or reduced to accommodate both large and small type particles. To reduce the size of the opening, cut line 43 is moved in the direction of the T slot. By controlling the location of the cut line 43, the pour rate of the contained product may be easily controlled to meet the requirements of the type of product being dispensed. As mentioned previously, by varying the size of cutout 27, the carton may be readily and inexpensively adapted to dispense products of various sizes. The size of cutout 27 can be easily change thereby altering the effective size of the dispensing opening while the size and configuration of the closure tab 44 remains constant. It should be noted however that the hinge line of the closure tab 44 need not coincide with fold line 29.

It should be recognized that while various embodiments in accordance with the present invention have been described, the present invention will be susceptible to numberous other changes and modifications which will become apparent to those skilled in the art from the foregoing disclosure. Therefore, the present invention should not be considered to be limited to the details shown and described herein, but encompasses all such changes and modifications as are within the scope of the appended claims.

What is claimed is:

1. A carton having a reclosable tear open pour spout for dispensing a pourable product comprising:

a plurality of side walls hingedly connected to one another by way of fold lines, a top wall and a bottom wall, with at least one of said side walls including an inner panel hingedly connected to one of said plurality of side walls by way of a fold line and having lateral edges and an outer panel hingedly connected to another of said plurality of side walls by way of a fold line and secured to said inner panel;

a discharge opening of a predetermined dimension formed in said inner panel, the entire perimeter of said discharge opening being spaced inwardly relative to each of said lateral edges and said fold line between said one side wall and said inner panel; and a closure means integrally formed in said outer panel and overlying said discharge opening, said closure means being hingedly connected at one end thereof to said another side wall along said fold line between said outer panel and said another side wall.

2. The carton as defined in claim 1, wherein said inner panel includes a crease score line extending substantially parallel to and spaced a sufficient distance from said fold line between said inner panel and said one side wall to coincide with the fold line between said outer panel and said another side wall so that a portion of said inner panel extends along an inner side of said another side wall.

3. The carton as defined in claim 2, wherein said predetermined dimension of said discharge opening is made dependent on the size of said pourable product between a maximum and a minimum limit.

4. The carton as defined in claim 3, wherein said second crease score line defines said maximum limit of the predetermined dimension of said discharge opening.

5. The carton as defined in claim 3, wherein the dimension of said closure means is independent of the size of said pourable product.

6. The carton as defined in claim 5, wherein the dimension of said closure means corresponds to that of said maximum limit.

7. The carton as defined in claim 1, wherein said discharge is a cutout formed in said inner panel.

8. The carton as defined in claim 1, wherein said discharge opening is a T-shaped cutout with a cross-bar of said T-shaped cutout extending substantially parallel to said fold line between said one side wall and said inner panel.

9. The carton as defined in claimed 8, wherein the position and size of said cross-bar remains constant and the position of at least one edge of said T-shaped cutout is determined according to the size of the pourable product to be placed in the carton.

10. The carton as defined in claim 1, wherein said closure means is a lift tab defined by a pair of substantially parallel reverse cut score regions extending from said fold line between said outer panel and said another side wall to an intermediate fold line formed in said lift tab and a pair of substantially parallel cut lines extending from said intermediate fold line to an edge of said outer panel.

11. The carton as defined in claim 10, wherein a ply separation region is formed in said inner panel between said discharge opening and said fold line between said inner panel and said one side wall wherein an extension portion of said lift tab defined by said intermediate fold line, said cut lines and said edge of said outer panel is adhesively secured to said ply separation region so that a ply separation occurs at said ply separation region and said reverse cut score regions in response to a lifting force being applied to said lift tab to expose said discharge opening.

12. The carton as defined in claim 11, wherein said discharge opening is a T-shaped cutout with a cross-bar portion of said T-shaped cutout extending substantially parallel to said fold lines between said inner panel and said one side wall.

13. The carton as defined in claim 12, wherein said extension portion of said lift tab is foldable along said intermediate fold line and insertable into said cross-bar portion of said T-shaped cutout to reclose said carton.

14. A carton having a reclosable tear open pour spout for dispensing a pourable product comprising:

a plurality of side walls hingedly connected to one another by way of fold lines, a top wall and a bottom wall, with at least one of said side walls including an inner panel hingedly connected to one of said plurality of side walls by way of a fold line and having lateral edges and an outer panel hingedly connected to another of said plurality of side walls by way of a fold line and secured to said inner panel;

a discharge opening of a predetermined dimension formed in said inner panel, the entire perimeter of said discharge opening being spaced inwardly relative to each of said lateral edges and said fold line between said one side wall and said inner panel; and a closure means integrally formed in said outer panel and overlying said discharge opening, said closure means being hingedly connected at one end thereof to said outer panel by way of a crease score line, opposed edges of said closure means being defined, at least in part, by a pair of opposed reverse cut score regions extending from said crease score line to an edge of said outer panel which substantially coincides with said fold line between said inner panel and said one side wall.

15. The carton as defined in claim 14, wherein said inner panel includes a second crease score line extending substantially parallel to and spaced a sufficient distance from said fold line between said inner panel and said one side wall to coincide with the fold line between said outer panel and said another side wall with one edge of said discharge opening extending substantially parallel to said second crease score line.

16. The carton as defined in claim 14, wherein said predetermined dimension of said discharge opening is made dependent on the size of said pourable product between a maximum and a minimum limit.

17. The carton as defined in claim 16, wherein said second crease score line defines said maximum limit of the predetermined dimension of said discharge opening.

18. The carton as defined in claim 16, wherein the dimension of said closure means is independent of the size of said pourable product.

19. The carton as defined in claim 17, wherein the dimension of said closure means corresponds to that of said maximum limit.

20. The carton as defined in claim 14, wherein said discharge opening is a cutout formed in said inner panel.

21. The carton as defined in claim 14, wherein said discharge opening is a T-shaped cutout with a cross-bar of said T-shaped cutout extending substantially parallel to said fold line between said side panel and said inner panel.

22. The carton as defined in claim 21, wherein the position and size of said cross-bar remains constant and the position of at least one edge of said T-shaped cutout is determined according to the size of the pourble product to be placed in the carton.

23. The carton as defined in claim 14, wherein said reverse cut score regions extend from said crease score line to an intermediate fold line formed in said closure meqans extending substantially parallel to said crease score line and said closure means further includes a lift tab defined by said intermediate fold line and a pair of substantially parallel cut lines extending from said intermediate fold line to said edge of said outer panel.

24. The carton as defined in claim 23, wherein a ply separation region is formed in said inner panel between said discharge opening and said fold line between said inner panel and said one side wall and wherein said lift tab is adhesively secured to said ply separation region so that a ply separation occurs at said ply separtion region and said reverse cut score regions in response to a lifting force being applied to said lift tab to expose said discharge opening.

25. The carton as defined in claim 24, wherein said discharge opening is a T-shaped cutout with a cross-bar portion of said T-shaped cutout extending substantially parallel to said fold line between said inner panel and said one side wall.

26. The carton as defined in claim 25, wherein said extension portion of said lift tab is foldable along said intermediate fold line and insertable into said cross-bar portion of said T-shaped cutout of reclose said carton.

27. A blank for forming a carton having a tear open pour spout for dispensing a pourable product comprising:

a first main panel having first and second side panels and end flaps hingedly connected thereto by way of fold lines, a second main panel hingedly connected to said second side panel and having a third side panel hingedly connected thereto by way of a fold line including exposed lateral edges, and end flaps hingedly connected thereto by way of fold lines, a discharge opening of a predetermined dimension formed in said third side panel, the entire perimeter of said discharge opening being spaced inwardly relative to each of said lateral edges and said fold line between said third panel and said second main panel; and a closure means integrally formed in said first side panel for overlying said discharge opening, said closure means being hingedly connected at one end thereof to said first side panel by way of a crease score line, opposed edges of said closure means being defined, at least in part, by a pair of opposed reverse cut score regions extending from said crease score line toward an edge of said first side panel which substantially coincides with said fold line between said third panel and said second main panel.

28. The blank as defined in claimed 27, wherein said third side panel includes a second crease score line extending substantially parallel to and spaced a sufficient distance from said fold line between said third side panel and said second main panel to coincide with the fold line between said first side panel and said first main panel, with one edge of said discharge opening extending substantially parallel to said second crease score line.

29. The blank as defined in claim 28, wherein said predetermined dimension of said discharge opening is directly dependent on the size of said pourable product between a maximum and a minimum limit.

30. The blank as defined in claim 29, wherein said second crease score line defines said maximum limit of the predetermined dimension of said discharge opening.

31. The blank as defined in claim 30, wherein the dimension of said closure means corresponds to that of said maximum limit.

32. The blank as defined in claim 27, wherein said discharge opening is a cutout formed in said third side panel.

33. The blank as defined in claim 27, wherein said discharge opening is a T-shaped cutout with a cross-bar of said T-shaped cutout extending substantially parallel to said fold line between said third side panel and said second main panel.

34. The blank as defined in claim 33, wherein the position and size of said cross-bar remains constant and the position of at least one edge of said T-shaped cutout is determined according to the size of the pourable product to be placed in the carton.

35. The blank as defined in claim 27, wherein said reverse cut score regions extend from said crease score line to an intermediate fold line formed in said closure means extending substantially parallel to said crease score line and said closure means further includes a lift tab defined by said intermediate fold line and a pair of substantially parallel cut lines extending from said intermediate fold line to said edge of said first side panel.

36. The blank as defined in claim 35, wherein a ply separation region is formed in said third side panel between said discharge opening and said fold line between said third side panel and said second main panel and wherein an extension portion of said lift tab defined by said intermediate fold line, said cut lines and said edge of said first side panel is adhesively secured to said ply separation region so that a ply separation occurs at said ply separation region and said reverse cut score regions in response to a lifting force being applied to said lift tab to expose said discharge opening.

37. The blank as defined in claim 36, wherein said discharge opening is a T-shaped cutout with a cross-bar portion of said T-shaped cutout extending substantially parallel to and adjacent to said fold line between said third side panel and said first main panel.

38. The blank as defined in claim 37, wherein said extension portion of said lift tab is foldable along said intermediate fold line and insertable into said cross-bar portion of said T-shaped cutout to reclose said carton.

* * * * *